US005546966A

United States Patent [19]

Lin

[11] Patent Number: 5,546,966

[45] Date of Patent: Aug. 20, 1996

[54] HAIR CLIP

[76] Inventor: Yeong-Bin Lin, P.O. Box 1750, Taichung, Taiwan

[21] Appl. No.: 379,286

[22] Filed: Jan. 27, 1995

[51] Int. Cl.[6] ..... A45D 8/28

[52] U.S. Cl. ..... 132/279; 132/276; 132/277; 132/278

[58] Field of Search ..... 132/276, 277, 132/279, 278, 282, 144, 273

[56] References Cited

U.S. PATENT DOCUMENTS

| | | | |
|---|---|---|---|
| 2,897,825 | 8/1959 | Wagner | 132/279 |
| 2,998,015 | 8/1961 | Gresham et al. | 132/279 |
| 3,412,739 | 11/1968 | Thatcher | 132/278 |
| 3,595,249 | 7/1971 | Solomon | 132/279 |
| 5,109,878 | 5/1992 | Kuo-Hua | 132/279 |

*Primary Examiner*—Nicholas D. Lucchesi
*Assistant Examiner*—Philogene Pedro

[57] ABSTRACT

A hair clip comprises a cover having two retaining projections engageable securely with a retaining hole of a base of the hair clip. The retaining projections are protected against the disturbance of an external force capable of causing the retaining projections of the cover to disengage the retaining hole of the base. The retaining projections are provided respectively and correspondingly with one or more adjustment retainers to facilitate the adjusting of the hair accommodating space located between the base and the cover of the hair clip.

1 Claim, 4 Drawing Sheets

HAIR CLIP

FIELD OF THE INVENTION

The present invention relates generally to a hair ornament, and more particularly to a hair clip which can be also used as a comb.

BACKGROUND OF THE INVENTION

As shown in Fig. 4, a hair clip of the prior art comprises a movable cover 3 provided at one end thereof with an arcuate retainer 31 having a bottom end which is provided with an inverted hook 32 engageable with a retaining portion 34 of a base 33 of the hair clip. When the hook 32 is engaged with the retaining portion 34 of the base 33, the bottom end of the arcuate retainer 31 is jutted out from the end of the base 33.

Such a prior art hair clip as described above is defective in design in that the jutted arcuate retainer 31 is rather vulnerable to being disturbed by an external force to bring about the disengagement of the hook 32 with the retaining portion 32 of the base 33.

SUMMARY OF THE INVENTION

It is therefore the primary objective of the present invention to provide a hair clip with a cover having two retaining projections engageable securely with a retaining hole of a base of the hair clip. The retaining projections are protected against the disturbance of an external force which may cause the retaining projections of the cover to disengage the retaining hole of the base. In addition, the two retaining projections are provided respectively and correspondingly with one or more adjustment retainers to facilitate the adjustment of the distance between the cover and the base in accordance with the density of hair.

The foregoing objective, features and advantages of the present invention will be more readily understood upon a thoughtful deliberation of the following detailed description of the present invention in conjunction with the accompanying drawings.

DETAILED DESCRIPTION OF THE INVENTION

Figure 1:
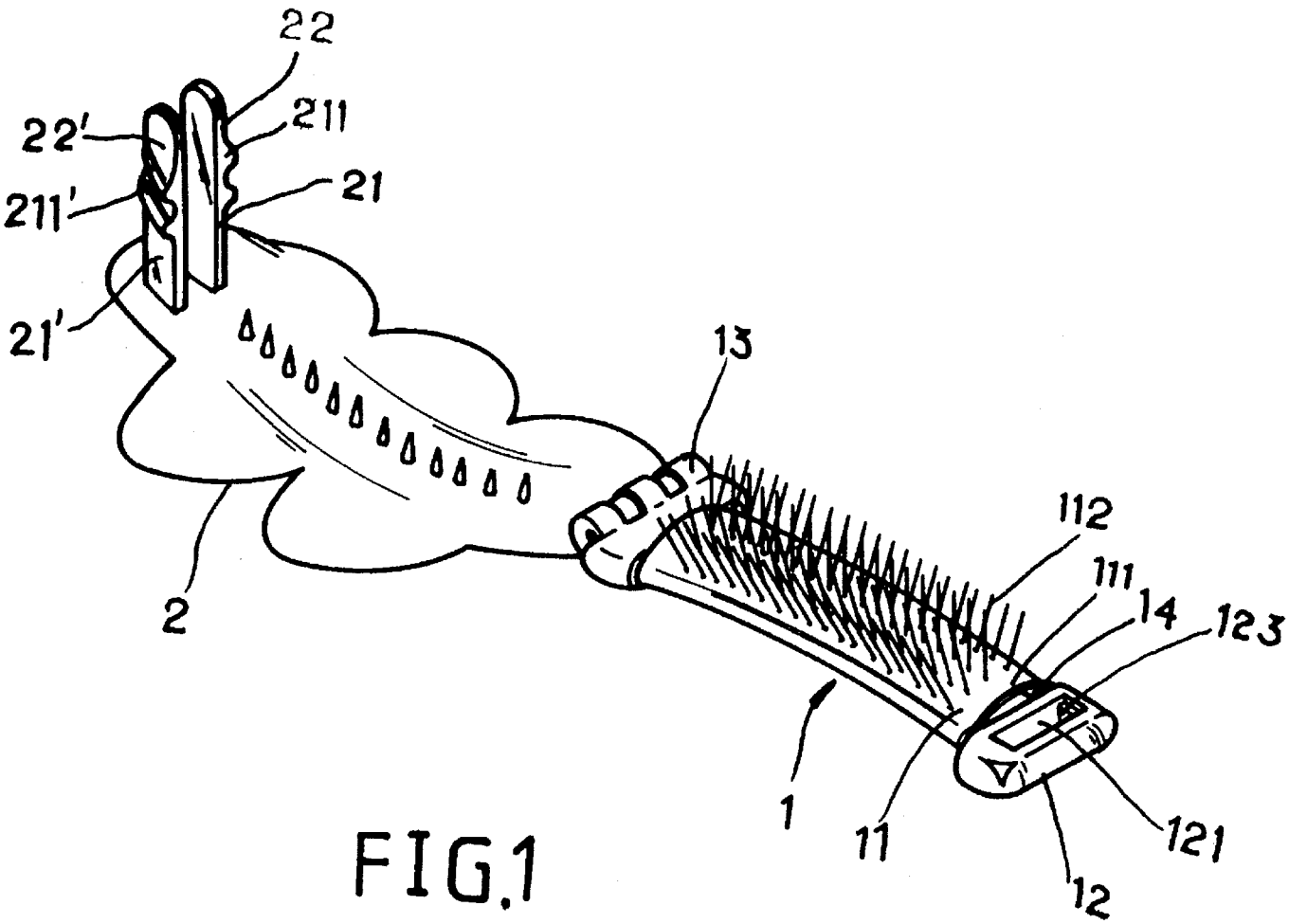
FIG. 1 shows a perspective view of a hair clip of the present invention.
Figure 2:
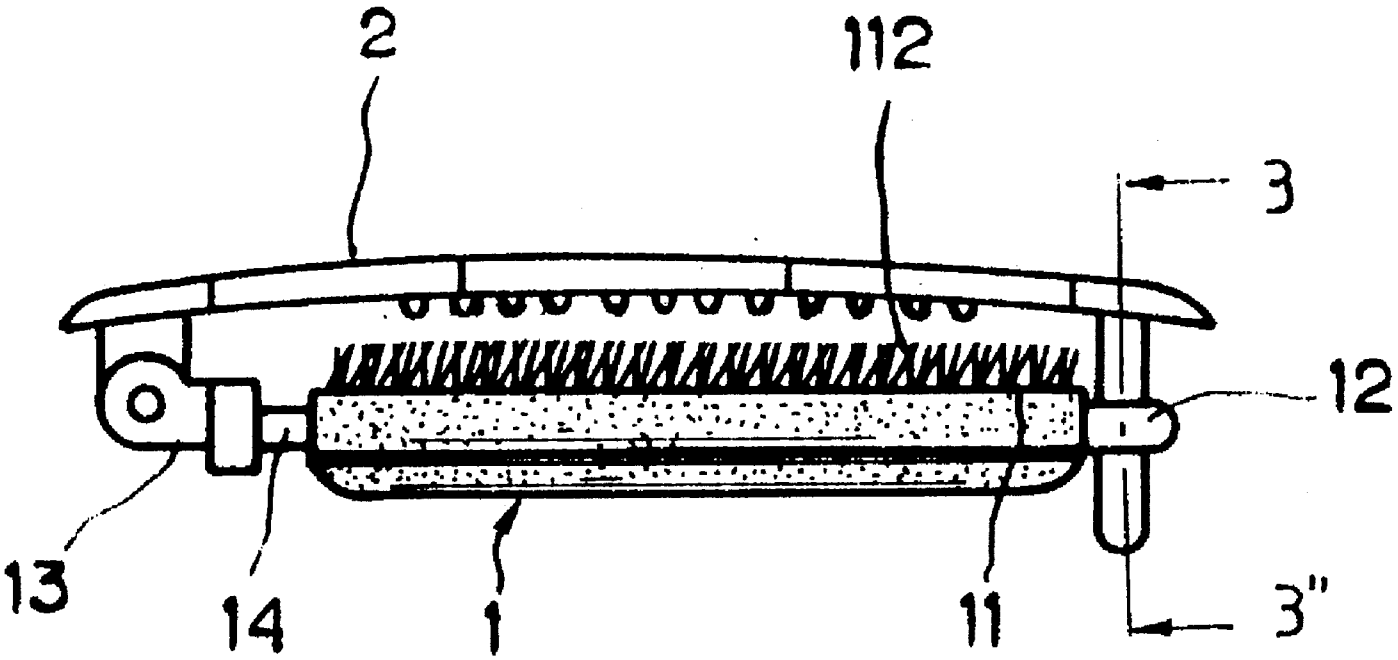
FIG. 2 shows a schematic view of the hair clip in use according to the present invention on as shown in FIG. 1.

As shown in FIGS. 1 and 2, a hair clip embodied in the present invention comprises mainly a base 1 and a cover 2.

Figure 3:
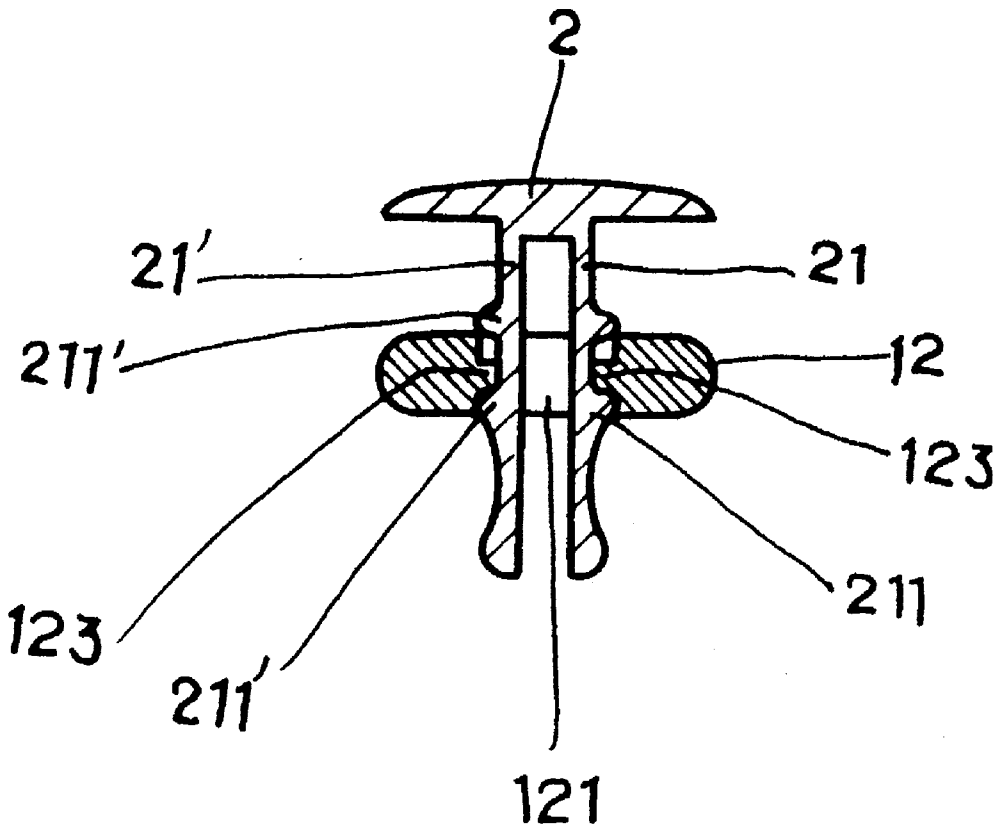
FIG. 3 shows a sectional view of a portion taken along the line 3—3 as shown in FIG.2.
Figure 4:
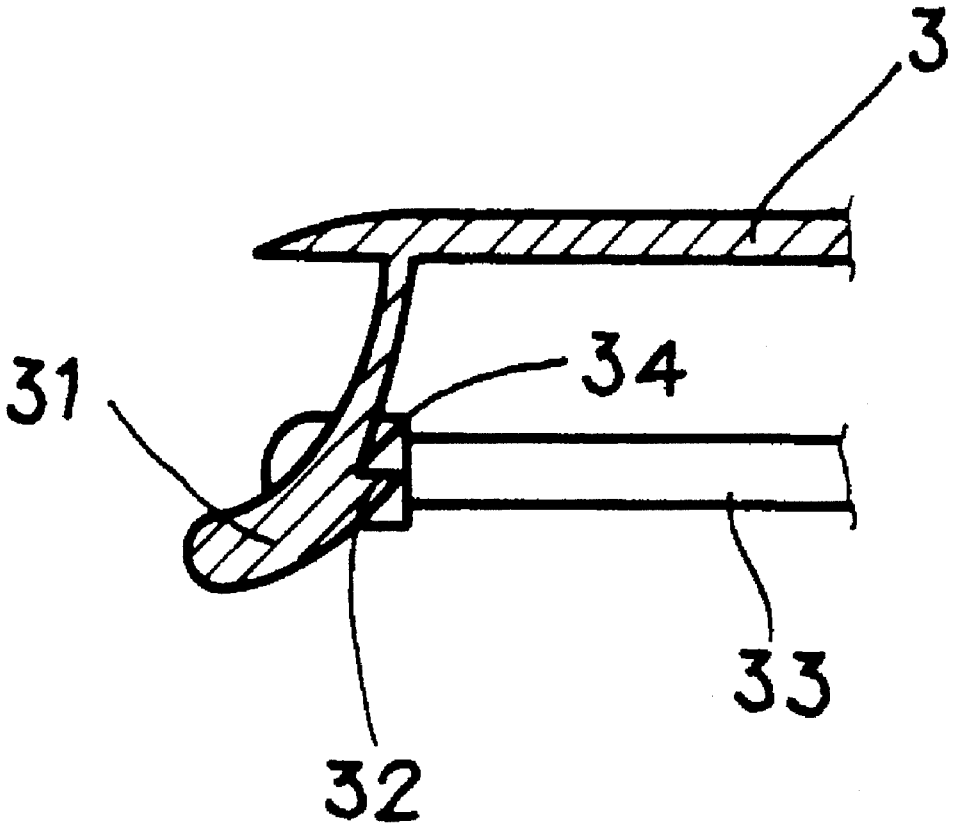
FIG. 4 PRIOR ART
FIG. 4 shows a partial sectional view of a hair clip of the prior art.

The base 1 has one end 13 which is fastened pivotally with one end of the cover 2. The base 1 is provided on an upper surface 11 thereof with a plastic layer 111 which is adhered securely thereto and provided thereon with rows of comb teeth 112. The upper surface 11 is disposed such that both ends of the upper surface 11 are fastened respectively with a cross bar 14. The base 1 is provided at the free end thereof with a retaining block 12 secured to one of the cross bars 14 and having centrally a retaining hole 121 which is provided on the inner wall thereof with two retaining protuberances 123 opposite in location to each other, as shown in FIG. 3.

The cover 2 is provided on the upper surface of one end thereof with two retaining projections 21 and 21' corresponding in location to and engageable with the retaining hole 121 of the base 1. The retaining projections 21 and 21' are provided respectively and correspondingly with a plurality of adjustment retainers 211 and 211' which are engageable respectively with the retaining protuberances 123 of the retaining hole 121.

The hair clip of the present invention can be used as a comb by spreading out the base 1 and the cover 2, as shown in FIG. 1.

Depending on the hair density, the distance between the base 1 and the cover 2 is adjusted when the base 1 and the cover 2 are joined together to hold the hair, as shown in FIG. 2. Such a distance adjustment as mentioned above is made possible by the adjustment retainers 211 and 211' of the retaining projections 21 and 21' of the cover 2.

As shown in FIG.1, the retaining projections 21 and 21' are further provided respectively with press portions 22 and 22', which can be pressed with finger to cause the retaining projections 21 and 21' to move aside so as to disengage the retaining protuberances 123 of the retaining hole 121, thereby bringing about the disengagement of the base 1 with the cover 2 to permit the removal of the hair clip of the present invention from the hair.

The embodiment of the present invention described above is to be regarded in all respects as merely illustrative and not restrictive. Accordingly, the present invention may be embodied in other specific forms without deviating from the spirit thereof. The present invention is therefore to be limited only by the scope of the following appended claim.

What is claimed is:

1. A hair clip comprising:

a base including an upper surface having a plastic layer secured thereto, said plastic layer including a plurality of comb teeth provided thereon, said base including two ends each having a cross bar extended therefrom, said base including a first end having a retaining block secured to a first of said cross bar and including a second end, said retaining block including a central retaining hole formed therein, said retaining hole including an inner wall having two retaining protuberances formed therein and opposite to each other; and a cover including a first end pivotally coupled to said second end of said base so as to allow said cover to rotate relative to said base about said first end of said cover, said cover including a second end having two retaining projections extended therefrom for engaging with said retaining hole of said retaining block of said base, said retaining projections each including at least one adjustment retainer having a protrusion formed thereon for engaging with said protuberances of said retaining block.

* * * * *